US009607494B2

(12) United States Patent
Pattok et al.

(10) Patent No.: US 9,607,494 B2
(45) Date of Patent: Mar. 28, 2017

(54) SUPERVISED INTERCONNECT SMOKE ALARM SYSTEM AND METHOD OF USING SAME

(75) Inventors: Greg R. Pattok, Holland, MI (US); Darin D. Tuttle, Byron Center, MI (US); David E. Christian, West Olive, MI (US); Scott R. Edwards, Alto, MI (US); David L. Newhouse, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 213 days.

(21) Appl. No.: 13/458,217

(22) Filed: Apr. 27, 2012

(65) Prior Publication Data

US 2013/0285805 A1 Oct. 31, 2013

(51) Int. Cl.

| | |
|---|---|
| ***G08B 29/00*** | (2006.01) |
| ***G08B 17/10*** | (2006.01) |
| ***G08B 25/04*** | (2006.01) |
| *G08B 21/14* | (2006.01) |

(52) U.S. Cl.

CPC ..... *G08B 17/10* (2013.01); *G08B 25/04* (2013.01); *G08B 21/14* (2013.01)

(58) Field of Classification Search

USPC ..... 340/506

See application file for complete search history.

(56) References Cited

U.S. PATENT DOCUMENTS

| | | | | |
|---|---|---|---|---|
| 3,521,276 | A | 7/1970 | Raber | |
| 3,641,570 | A | 2/1972 | Thompson | |
| 3,711,854 | A | 1/1973 | Reynolds et al. | |
| 4,017,852 | A | 4/1977 | Kabat | |
| 4,206,449 | A * | 6/1980 | Galvin et al. | 340/505 |
| 4,400,694 | A * | 8/1983 | Wong et al. | 340/505 |
| 4,673,920 | A * | 6/1987 | Ferguson et al. | 340/521 |
| 5,444,695 | A * | 8/1995 | Copley et al. | 370/452 |
| 5,787,258 | A * | 7/1998 | Costa et al. | 709/251 |
| 6,292,541 | B1 | 9/2001 | Tice et al. | |
| 6,901,066 | B1 * | 5/2005 | Helgeson | 370/348 |
| 2004/0165890 | A1 * | 8/2004 | Tomich | H04Q 11/0067 398/79 |
| 2005/0128093 | A1 * | 6/2005 | Genova et al. | 340/577 |
| 2006/0250947 | A1 * | 11/2006 | Allen | 370/216 |
| 2011/0025341 | A1 | 2/2011 | Lupaczyk et al. | |
| 2011/0043367 | A1 * | 2/2011 | Becker et al. | 340/577 |

* cited by examiner

*Primary Examiner* — Brian Zimmerman
*Assistant Examiner* — Kevin Lau
(74) *Attorney, Agent, or Firm* — Prive Heneveld LLP; Bradley D. Johnson

(57) ABSTRACT

A smoke alarm system for providing interconnect supervision between detectors includes smoke detectors configured so that an interconnect line extends between each of the smoke detectors. In one embodiment using a wired connection, each of the smoke detectors includes an interconnect input and an interconnect output for connecting the smoke detectors into a loop configuration. Similarly, the system may also operate to provide interconnect supervision in a wireless manner such that each of the smoke detectors is polled on a periodic basis. Thus, the smoke alarm system uses interconnect supervision for alerting other detectors of a smoke and/or carbon monoxide alarm as well as altering other detectors to a fault condition.

19 Claims, 6 Drawing Sheets

SUPERVISED INTERCONNECT SMOKE ALARM SYSTEM AND METHOD OF USING SAME

FIELD OF THE INVENTION

The present invention relates generally to an alarm system interconnection and more particularly to an alarm system for interconnecting hazardous environmental condition detectors for proving supervision amongst detectors in the system and method thereof.

BACKGROUND

Electronic fire and smoke detection systems have been used for many years in both commercial and home applications. These systems range from simple to extremely complex architectures and work to detect fire and/or smoke to alter occupants of a building to hazards within a building. Prior art FIG. 1A illustrates a typical smoke detection topology where the alarm system 100 includes a plurality of smoke detectors 101, 103, and 105 that are each powered over a common power bus 102 such as the AC mains 104. The common power bus 102 also connects to an electrical panel 107. Each detector 101, 103, 105 utilizes a separate control bus line 101*a*, 103*a*, 105*a* that extends back to connect the respective detector and an electrical panel 107. The electrical panel 107 is used for transmitting and receiving alarm commands from each of the fire alarm detectors 101, 103, 105 via the respective control bus 101*a*, 103*a*, 105*a*.

Similarly, FIG. 1B is a block diagram illustrating a second type of fire alarm topology commonly used in the prior art. The alarm system 150 illustrates a plurality of smoke detectors 151, 153, 155, which are each powered over a common power bus 157 such as AC mains 159. The common power bus is also connected to an electrical panel 163. Each detector 151, 153 and 155 is interconnected using an interconnect bus 161*a*, 161*b* while a portion of the interconnect bus 161*c* also connects with an electrical panel. Each of the detectors 151, 153, 155 generally includes a relay so that when a fire or smoke is detected, these contacts close to notify the electrical panel of an alarm condition.

Although the fire alarm systems 100, 150 can allow one or more of the detectors to communicate using an individual or interconnected control bus, a drawback of these types of systems occurs if the control bus and/or interconnect bus becomes disconnected or otherwise disabled. When this occurs, any communication with the electrical panel 107, 163 will become disabled and the remaining detectors will continue to operate as if no problem exists.

SUMMARY OF THE INVENTION

An embodiment of the invention includes a hazardous environment condition notification appliance system for providing interconnect supervision that includes one or more notification appliances that are each interconnected to form a loop configuration. The notification appliances use at least one interconnect line extending between the devices for providing supervision between devices without the use of a central control panel. In another embodiment, a supervised interconnect smoke alarm system includes one or more smoke detectors where an interconnect line extends between each of the smoke detectors. The smoke detectors include an interconnect input and an interconnect output for connecting the smoke detectors into a loop configuration for detecting operational status between each one of the detectors. In still yet another embodiment, a notification appliance that includes an interconnect input connector configured to receive an input signal from a first remote notification appliance and an interconnect output connector configured to transmit an output signal to a second remote notification appliance. A processor is configured to be in communication with the interconnect input and the interconnect output where the processor determines if the input signal is received within a predetermined time period for indicating if the first remote notification appliance is operating properly.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1A:
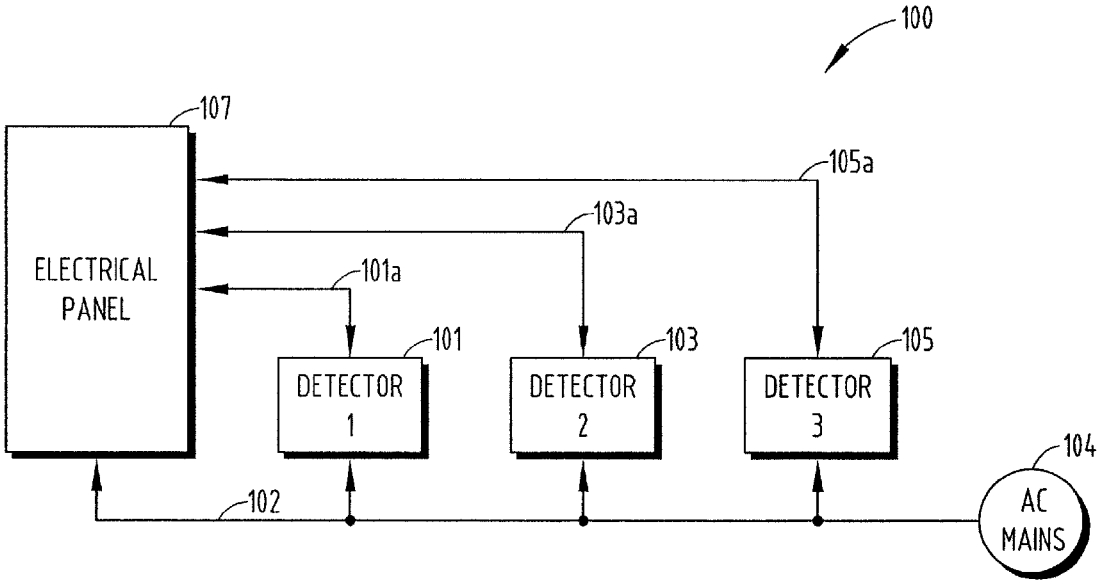
FIG. 1A (PRIOR ART)
FIG. 1A and FIG. 1B are block diagrams showing smoke detector systems that are typically used in the prior art.
Figure 1B:
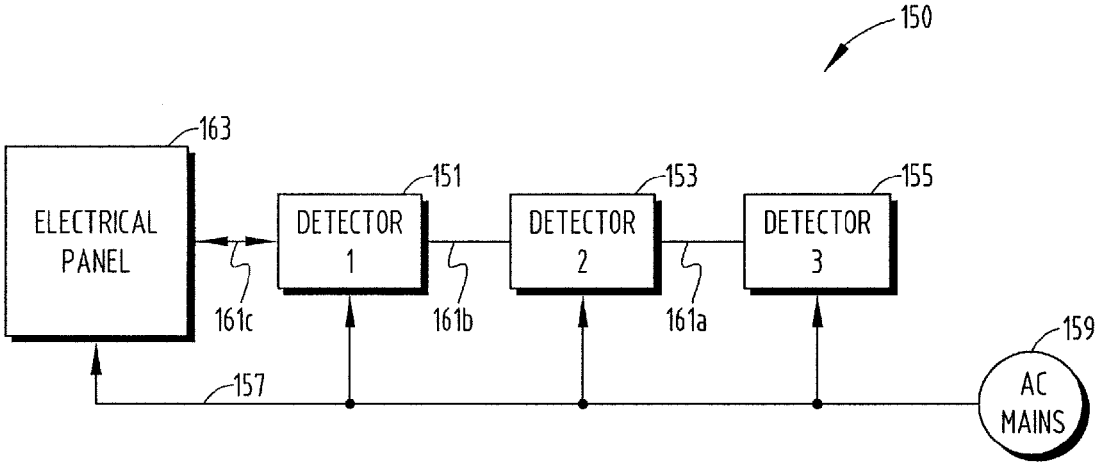
FIG. 1B (PRIOR ART)

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a smoke alarm interconnect supervision system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control one or more processors to implement, in conjunction with certain non-processor circuits, some, most, or all of the functions of a hazardous environmental condition interconnect supervision system, as described herein. The non-processor circuits may include, but are not limited to signal drivers, clock circuits, power source circuits, and/or user input devices. As such, these functions may be interpreted as steps of a method used in using or constructing a hazardous environmental condition interconnect supervision system. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, the methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Figure 2A:
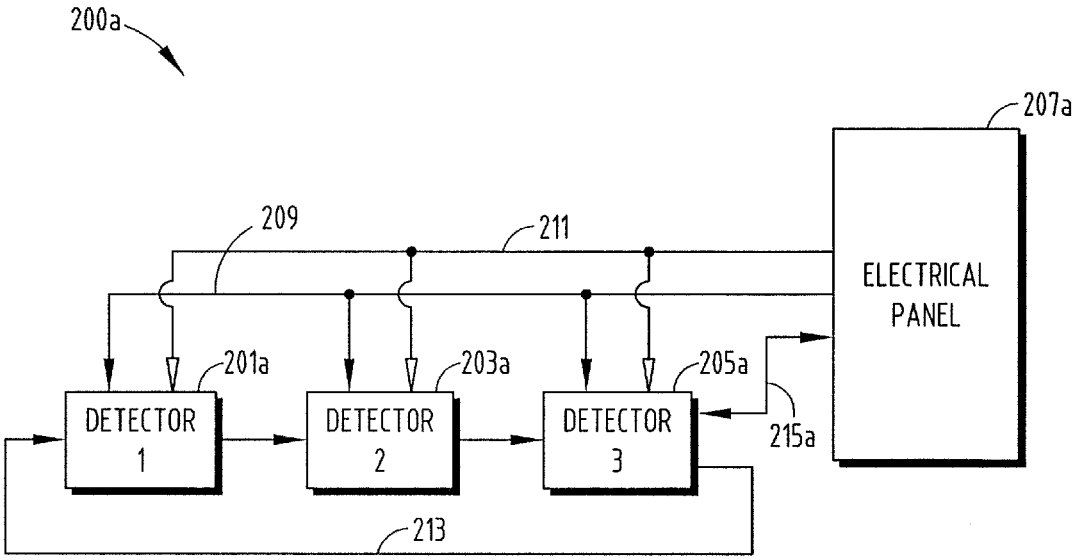
FIGS. 2A and 2B are block diagrams showing the smoke alarm interconnect supervision system according to wired and radio frequency (RF) embodiments of the invention.
Figure 2B:
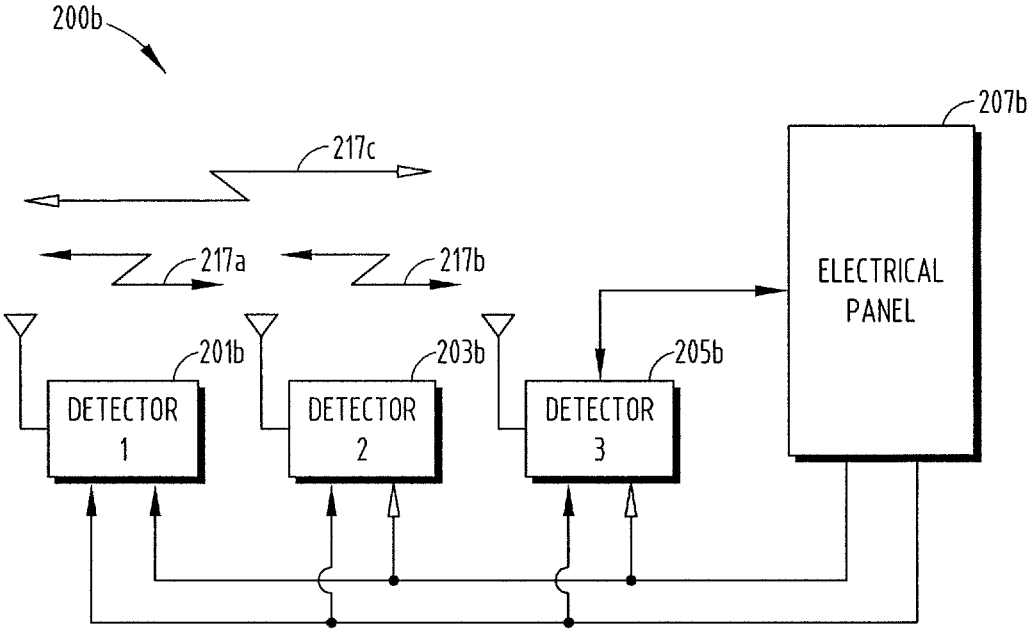

FIGS. 2A and 2B are block diagrams showing the hazardous environmental condition detector systems according to various embodiments of the present invention. Those skilled in the art will recognize that a hazardous environmental condition detector system includes but is not limited to such detectors as smoke, heat, carbon monoxide (CO) as well as a visual strobe only device. In the wired embodiment shown in FIG. 2A, the hazardous environmental condition interconnect system 200*a* includes one or more notification appliances 201*a*, 203*a* and 205*a* that are each serially connected to an electrical panel 207 via electrical bus power lines 209, 211. Electrical lines 209, 211 act as a common electrical bus for providing DC power to each of notification appliances 201*a*, 203*a*, 205*a*. Although any voltage could be used, 28 volts DC is typically the supply voltage according to the standard. Each of the detectors may also use an internal battery having a predetermined voltage that acts as a backup in the event of power failure.

An interconnect line 213 interconnects each of the notification appliance 201*a*, 203*a*, 205*a* in a daisy chain or loop-like configuration such that interconnect line 213 not only extends between detectors, but also loops back from the last notification appliance 205*a* to the first notification appliance 201*a* to form the loop. As will be described herein, the interconnect line 213 is multifunctional and is used for supervision by each of the notification appliances 201*a*, 203*a*, 205*a* for determining when the interconnect line 213 or a notification appliance as become broken, disabled or defective. An alarm condition is reported to the electrical panel 207 by way of a bus such as alarm line 215*a*. Alternatively, if the hazardous environmental condition detector system does not have a panel, then the next detector in the chain can provide an alert if it did not receive an anticipated signal. By detecting this type of trouble or fault condition using an interconnect line 213, a greater number of detection devices (smoke, heat, CO or other types) can be connected together since each will detect faults in the system. For example, using an interconnect system of this type and the use of the interconnect line 213, the current fire code enables 64 devices to be used in the system where as many as 48 devices can be smoke detectors.

As seen in FIG. 2A, the notification appliances 201*a*, 203*a*, 205*a* are connected in a loop through the interconnect line 213 such that there are four connections for each detector. These include but are not limited to electrical lines 209, 211 for supplying DC power while the interconnect line 213 has a separate input and output connection. Thus, the interconnect line 213 is configured having an input/output such that the input connection (interconnect IN) comes from the output connection (interconnect OUT) from the previous or upstream device to form a daisy chain loop. Although only three notification appliances 201*a*, 203*a*, 205*a* are illustrated in the example shown in FIG. 2A, it should be evident to those skilled in the art that any number of tenderly connected notification appliances are within the scope of the invention. Thus, any number of notification appliances might be used to form a loop configuration. When in use, each of the notification appliances 201*a*, 203*a*, 205*a* will in seriatim change the logic state (high or low) of the OUT interconnect line over a predetermined time period. As this process is unidirectional on the interconnect line 213, this enables other downstream detectors in the loop to detect a change in logic state on their respective IN interconnect line. If this change in state is not observed within the predetermined time period, e.g. 3 minutes, the detector will sound a trouble alert such as a chirp, beep or other alarm to indicate to persons near the vicinity of smoke alarm system 200*a* that a fault has occurred and the overall system integrity is compromised.

In addition, the same IN interconnect and OUT interconnect connections for each of the detectors 201*a*, 203*a*, 205*a* also serve as the means to communicate the alarm status to all detectors interconnected via the interconnect line 213. This enables a detector, such as detector 205, to provide notification to the electrical panel 207*a* via the alarm line 215*a*. Those skilled in the art will further recognize that the alarm line 215*a* can be comprised of one or more wired connections connecting to the electrical panel 207*a*. Thus, if a change in state occurs in less than the 180 second time limit, a detector will recognize that an alarm event (e.g. fire, smoke or CO) has occurred, at which point a sounder in the notification appliances 201*a*, 203, 205*a* will annunciate the fault using the interconnect line 213 and notify the electrical panel using the alarm line 215*a*. The electrical panel can then notify a central alarm using a telephone, Internet or RF connection so that a fire department or other emergency service can be notified of the alarm condition.

In addition, each notification appliance 201*a*, 203*a*, 205*a* is also able to determine the type of alarm that is on the interconnect line 213, for example, three long pulses can indicate smoke detection while four short pulses can indicate the detection of carbon monoxide (CO). Since the interconnect system 200*a* can recognize alarm types, this allows the alarm to not only signal building occupants to the type of alert, but also can prioritize one type of alert over the detection of another. For example, if a detector were sounding for a CO detection, it will sound four short pulses and will drive its OUT interconnect with four short pulses. If this alarm subsequently detects three long pulses on its IN interconnect, it will stop signaling the CO alarm with the four short pulses and switch to three long pulses if the detectors were set to prioritize for smoke or another type of detection.

Thus, each notification appliance 201*a*, 203*a*, 205*a* includes an interconnect input connector configured to receive an input signal from a first remote notification appliance. An interconnect output connector is configured to transmit an output signal to a second remote notification appliance while a processor is used that is in communication with the interconnect input and the interconnect output. The processor is configured to determine if the input signal is received within a predetermined time period in order to determine if the first remote notification appliance is operating properly. As noted herein regarding the system operation, each of the plurality of notification appliances changes a signal state (for example, high or low) so that a fault condition can easily be detected during polling by the other of the plurality of notification appliances. Power to the plurality of notification appliances is supplied via at least one power bus and battery backup. As noted herein, the notification appliance can be configured to detect smoke, heat, fire, carbon monoxide and/or other hazardous conditions.

FIG. 2B illustrates a block diagram showing a wireless embodiment where the wireless interconnect line is a radio frequency (RF) connection. In the wireless embodiment shown in FIG. 2B, the smoke alarm interconnect system 200*b* includes one or more smoke alarm detectors 201*b*, 203*b* and 205*b* that are each serially connected to an electrical panel 207*b* via electrical bus power lines. These electrical lines act as a common electrical bus for providing DC power to each of smoke detectors 201*b*, 203*b*, 205*b*. Although any voltage could be used, 28 volts DC is typically the supply voltage. As in the wired embodiment, each of the detectors may also use an internal battery having a predetermined voltage that acts as a backup on the event of power failure.

The hardwired interconnect, may also include a transceiver for providing a wireless interconnection between each of the smoke alarm detectors 201*b*, 203*b* and 205*b*. In this configuration, each of the hazard alarms 201*b*, 203*b* and 205*b* will be polled in-seriatim from one or more of the other alarms so that a malfunction or alarm condition can be easily detected. As seen in FIG. 2B, a radio frequency (RF) interconnection 217*a*, 217*b* and 217*c* illustrate how each of the alarms 201*b*, 203*b* and 205*b* establish a wireless loop in order to facilitate communication between the alarms. As described with regard to FIG. 2A, data on each of the RF interconnection 217*a*, 217*b* and 217*c* can be altered or changes state which can then indicate a malfunction or alarm condition between detectors. Thus, the RF interconnection can emulate an IN interconnect and OUT interconnect as described with regard to FIG. 2A. An alarm line can also be interconnected between one of the detectors for providing status or alarm information to the electrical panel 207*b*. The electrical panel can then be connected to a telephone, Internet or RF link for notifying police, fire or other emergency services.

Figure 2C:
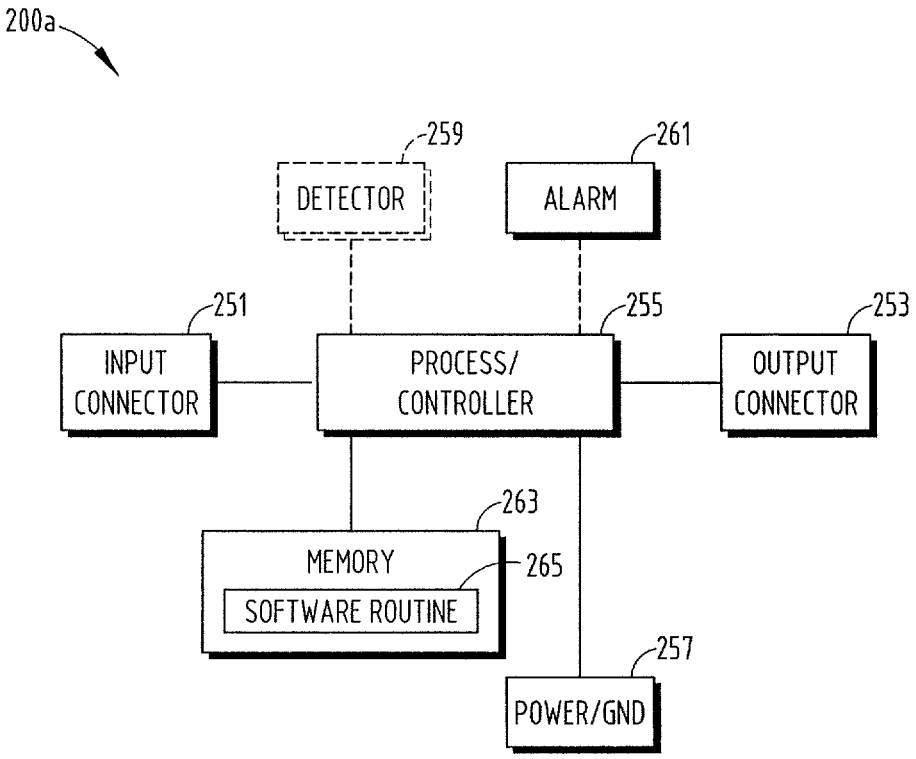
FIG. 2C is a block diagram of a hazard alarm used according to various embodiments of the invention.

FIG. 2C is a block diagram of a hazard alarm used in accordance with an embodiment of the invention. The hazard alarm 200*a* includes hardwired interconnects such as input connector 251 and output connector 253 that operate to provide interconnect data to a processor/controller 255. As described herein, the processor/controller 255 processes data that is communicated along the interconnect IN and interconnect OUT lines for notifying a downstream hazard alarm of an alarm and/or fault condition. A detector 259 and/or alarm 261 are connected with the processor 255 where the detector 259 provides input information for various alarm states that may include but are not limited to smoke, heat, fire, CO or other hazardous conditions. The detector 259 is illustrated in phantom as it may be integrated with the hazard alarm 200*a* or may be an external connection. The alarm 261 operates to sound an audible tone or visual warning, e.g. a lighting strobe, once a hazard is detected. The processor can use a memory 263 as well as a software routine 265 for storing information and/or controlling various operational aspects of the processor/controller 255 so as to achieve desired system operation. The processor/controller 255 is powered by a power main or external power source 257 for operating the processor and other electrical components.

Figure 3:
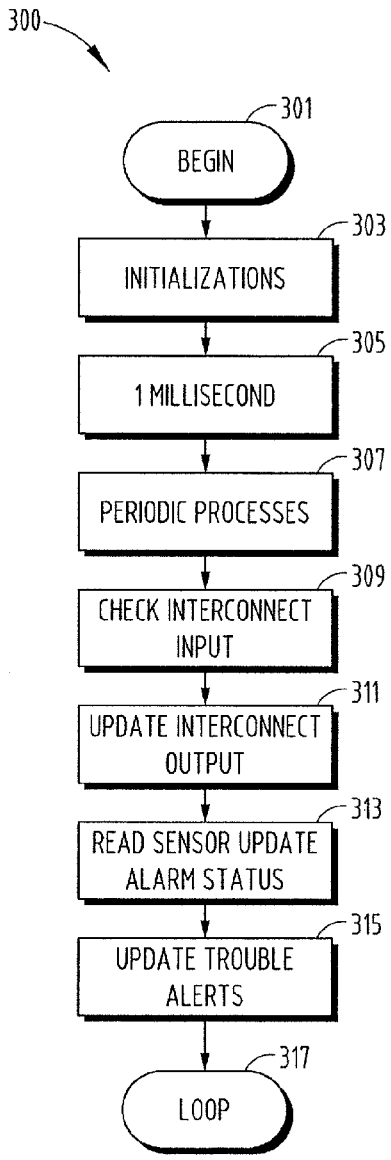
FIG. 3 is a flow chart diagram illustrating the overall process used in updating alarm status and detecting a trouble alert.

FIG. 3 is a flow chart diagram illustrating the overall process 300 used in updating alarm status and detecting trouble alerts in one station i.e. at one detector in the system as shown in FIG. 2A. The process begins (step 301) where each smoke detector is first initialized (step 303) using a one-millisecond (1 ms) timing period that is triggered (step 305) which starts the timing period detection process. This process is used by each detector for detecting smoke, CO or other hazards (step 307). Although 1 ms is used here by way of example, it should also be evident to those skilled in the art that a longer or shorter period for detection is also possible. As described herein, each detector is connected by an interconnect line having both an IN interconnect and OUT interconnect for each detector, and is typically arranged in a tandem-like configuration. At the start of the timing period, the IN interconnect input is first checked (step 309) for a change in logic state. The result of this check or test is then used to update the OUT interconnect (step 311) so that other "down stream" detectors in the loop can be notified of any state change. Thereafter, the various sensors are read and the alarm status is updated for the respective detector (step 313). At each detector, the trouble alerts are then updated (step 315) and the process (step 317) begins again where the 1 ms window is reset.

Figure 4:
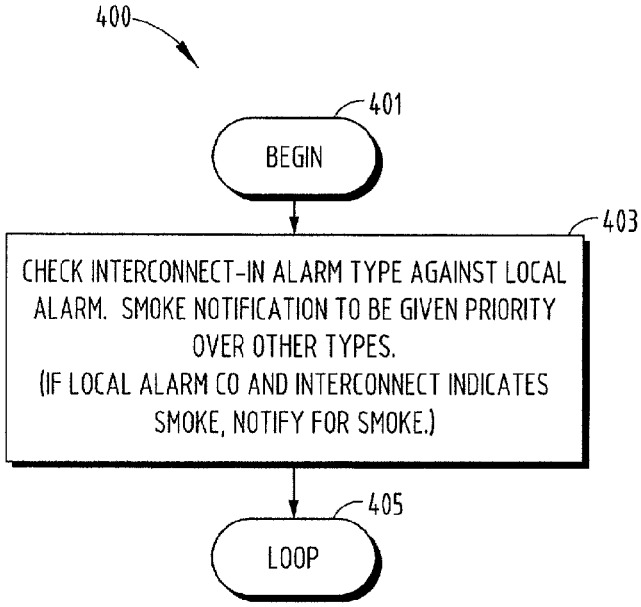
FIG. 4 is a flow chart diagram illustrating the process of checking tandem alarm type versus local alarm type.

FIG. 4 is a flow chart diagram illustrating the process 400 of checking tandem alarm type versus local alarm type as described with regard to the reading step 313 in FIG. 3. After the timers and alarms are each updated (step 401), the various sensors in the detector are updated by detecting an alarm signal on its IN interconnect which indicates the alarm type, e.g. four short pulses for CO as compared to three long pulses for smoke. This is checked against what is currently being signaled locally on its OUT interconnect (step 403). In accordance with NFPA code, smoke alarm notification is always given priority over other types of alarms such as CO. Thus, if a local alarm is sounding for CO, and the interconnect IN indicates a smoke condition, then the detector will recognize this priority and change its annunciation or alarm to indicate a smoke alert. Those skilled in the art will recognize the term "alarm" to cover both audible and visual alarm conditions.

Figure 5:
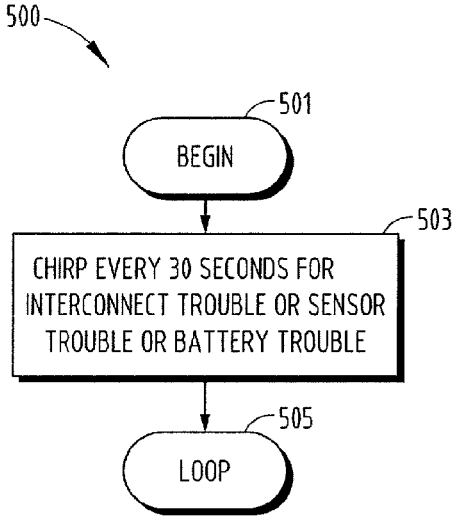
FIG. 5 is a flow chart diagram illustrating the process used in updating a trouble alert.

FIG. 5 is a flow chart diagram illustrating the process used in updating a trouble alert as shown in the updating step 315 of FIG. 3. The updating process 500 includes updating the trouble alerts (step 501) on the detectors interconnect OUT if a state change is detected on the interconnect IN. Thereafter, a chirp or other annunciation is provided for a predetermined time period, e.g. 30 seconds under various trouble conditions. These trouble conditions can include if there is a fault detected on the interconnect line, sensor trouble and/or the battery backup drops below a predetermined threshold (step 503). Thereafter, a return (step 505) is provided where the entire process begins again.

Figure 6:
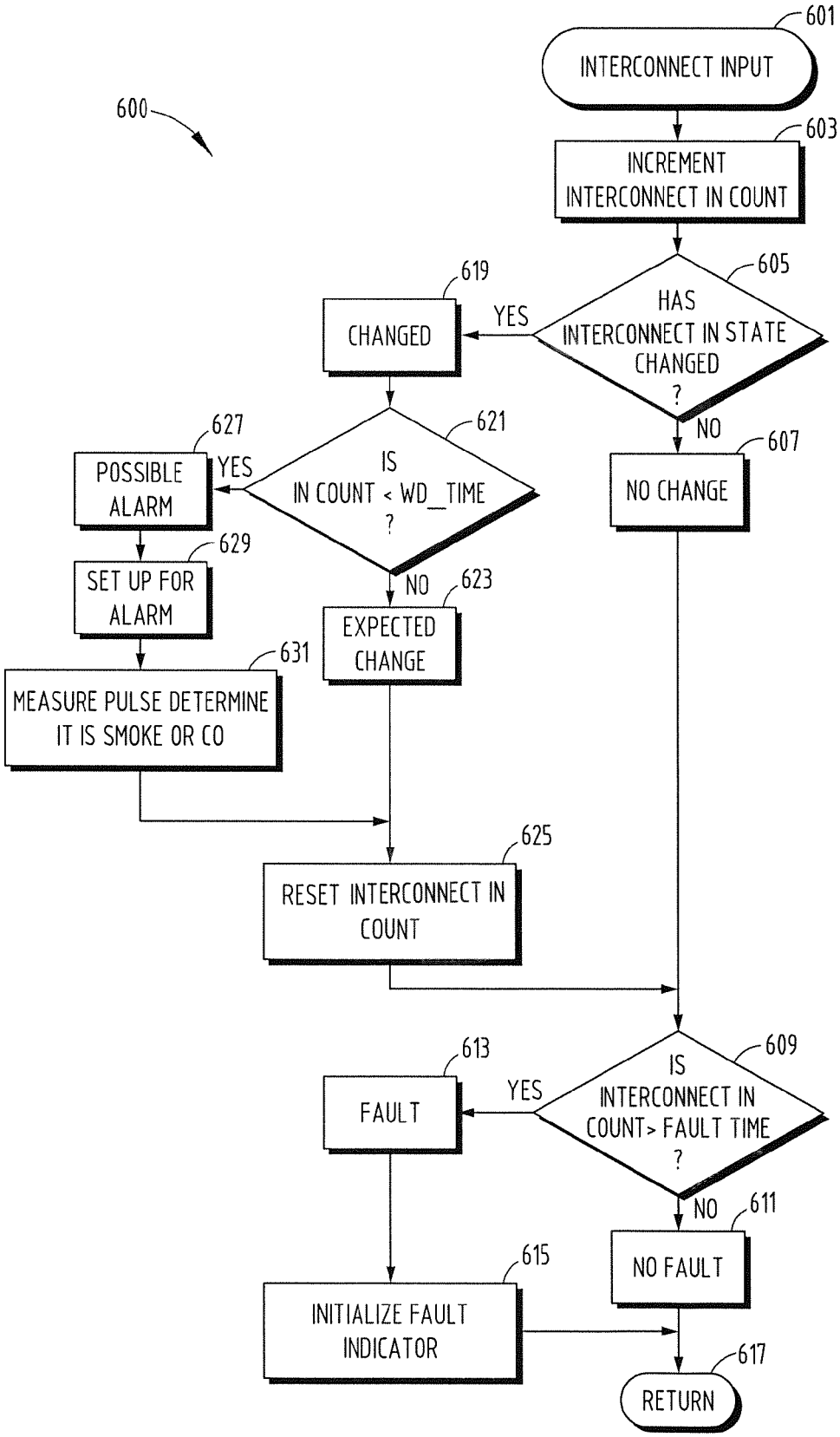
FIG. 6 is a flow chart diagram illustrating the process of determining if an alarm has occurred based on a change of state in the interconnect line.

FIG. 6 is a flow chart diagram illustrating the process of determining if an alarm has occurred based on a change of state on the interconnect IN line. The process of determining alarm status 600 includes monitoring the interconnect IN (step 601) and then incrementing an interconnect IN count (step 603). A determination is made if the interconnect IN state has changed (step 605). If there has been no logic state change (step 607), another determination is made if the interconnect IN count is greater than a predetermined fault time (step 609). If the interconnect fault time has not been exceeded and there is no fault (step 611), then the process starts over again (step 617). However, if the fault time has been exceeded, this indicates an interconnect line fault condition (step 613), where a fault indicator is initialized (step 615) to alert occupants of the building and the process returns to start again (step 617).

After determining if the interconnect IN state has changed (step 605), when the state of the interconnect IN has changed (step 619), a determination is made if a watch dog (WD) timer is greater than the interconnect IN count (step 621). The WD timer is a timer used to determine when a signal on an interconnect IN is to change state e.g., 1 or 0. A change of state will reset the count. When the WD timer is not greater than the interconnect IN count, then this must be an "expected" change (step 623) and the interconnect IN count is reset (step 625). Thereafter, the step of determining if the interconnect IN count is greater than the fault time (step 609) is again made so that a fault (step 613) or no fault interconnect line condition (step 611) is determined. If there is a fault, then the fault detector (step 615) is reinitialized and the process begins again (step 617).

In the determining step 621, if the WD timer has a value greater than the interconnect IN count (step 627), then an alarm annunciation is set up (step 629) and the number of pulses is measured to determine if a smoke, CO or other type of alarm is detected (step 631). Thereafter, the interconnect IN count is reset (step 625) and it is determined if the interconnect IN count is greater than the fault time. If not, this indicates a no fault condition (step 611) and the process begins again (step 617). If the count is greater then the fault time, a fault has occurred (step 613) and the fault indicator is initialized (step 615) and the process starts over (step 617). Thus, the method as described with regard to FIG. 6 illustrates how a detector can detect both a fault condition on the interconnect IN as well as the type of alarm (smoke or CO) received from an upstream detector.

Figure 7:
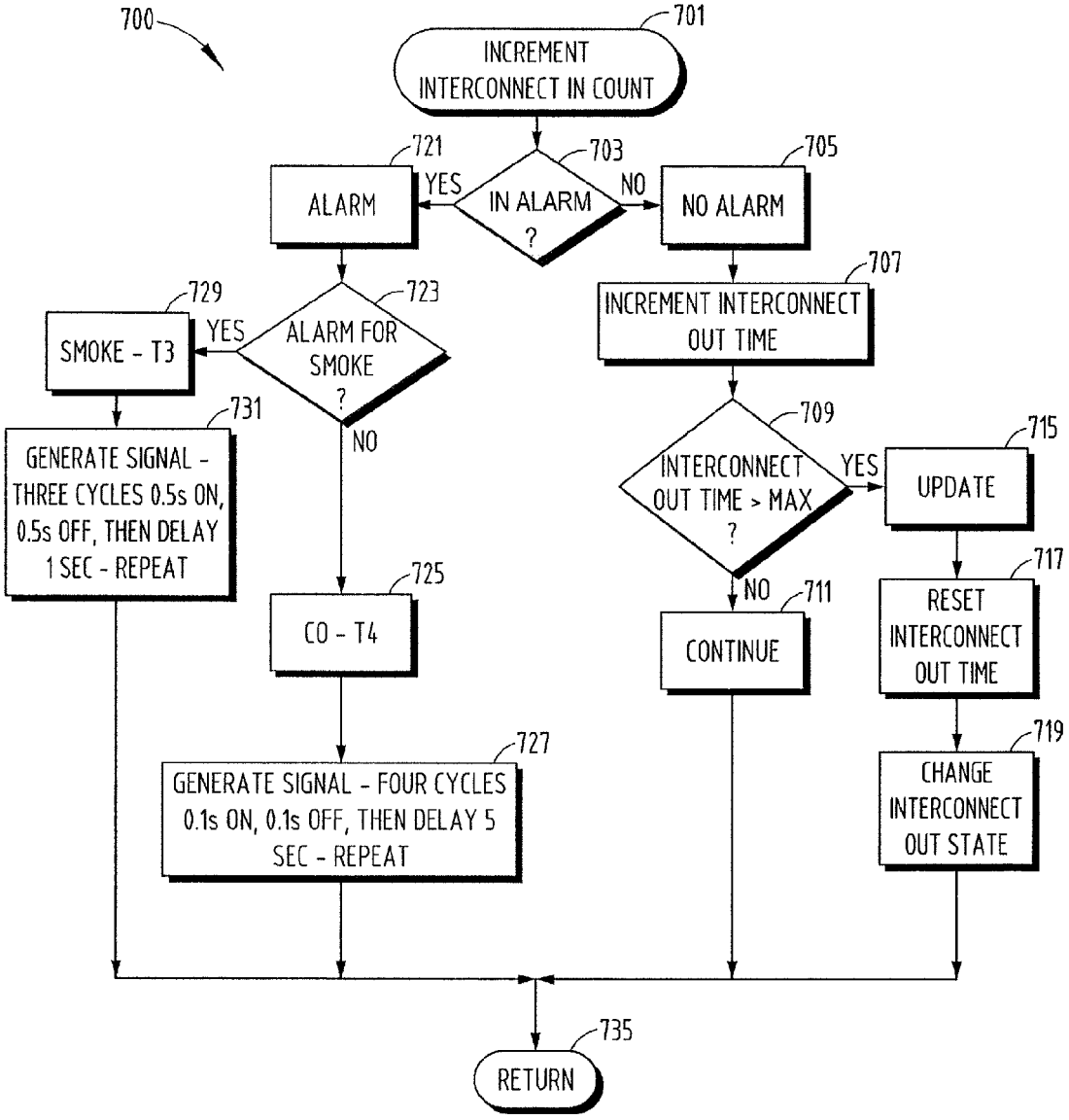
FIG. 7 is a flow chart diagram illustrating the process of informing other detectors of an alarm on an interconnect OUT line.

FIG. 7 is a flow chart diagram illustrating the process of informing other detectors of an alarm on the interconnect OUT line. This process 700 begins on the interconnect OUT line (step 701) where a determination is made if an alarm has occurred (step 703) based on a change of logic state on the interconnect IN line. If no alarm has occurred, then the interconnect OUT time is incremented (step 707) and a determination is made if the interconnect OUT time is greater than an upper limit or maximum amount (step 709). If this time has not been exceeded (step 711), then the process starts again (step 735). However, if the time has been exceeded, then a counter is updated (step 715) and the interconnect OUT time is reset (step 717). Thereafter, the interconnect OUT state is changed (step 719) for use by the next detector downstream in the loop and the process begins again (step 735).

If it is determined that an alarm is detected on the interconnect IN line (step 703), then it is further determined if the pulse type designating an alarm (step 721) is a smoke alarm (step 723). If it is not a smoke alarm but instead is a CO alarm (step 725), then the appropriate logic signal pulses are generated at the interconnect OUT line (step 727). For example, four cycles in an "on" state for 0.1 second, then 0.1 second "off," then a delay of 5 seconds, and then this sequence is repeated. Thereafter, the process starts again (step 735) at the interconnect OUT line (step 703). If a determination indicates that the alarm is a smoke alarm (step 723), then the smoke alarm (step 729) will generate a signal on the interconnect OUT line that can, for example, have three cycles for 0.5 second in an "on" state, then 0.5 second "off," then a delay of 1 second, and then this sequence is repeated. Thereafter, the process begins again at return step 735. Hence, the method as described with regard to FIG. 7 illustrates the processes used to notify downstream detectors of a fault condition on the interconnect line as well as the type of alarm that is being detected by that particular detector.

Thus, according to an embodiment of the present invention, a notification appliance interconnect supervision system uses an interconnect line for supervising a plurality of notification appliances in a loop configuration. This system offers an advantage in that it allows more than 12 interconnected smoke detectors where each detector can detect an interconnect fault. Moreover, the system also allows the detectors to communicate its alarm status to all detectors in the system as well as an electrical panel. In use, if a change in state occurs on the interconnect line in less than a predetermined time period, a detector will recognize that a fault has occurred and initiate a sounder alarm in the smoke detector to annunciate a broken or shorted interconnect. The system also enables a detector to determine the type of alarm that is on the interconnect IN line, e.g., three long pulses can indicate smoke detection while four short pulses can indicate CO detection. Thus, the detector determines the type of alarm that is on its interconnect IN line based on the number of pulses received for sounding either a smoke or CO alarm. This supervised smoke detector system offers both greater reliability and expandability over typically residential smoke detection system as used in the prior art.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A supervised interconnect hazard alarm system for providing interconnect supervision comprising:

a plurality of notification appliances comprising:

a first notification appliance;

a second notification appliance interconnected with the first notification appliance and configured to receive an input from the first notification appliance; and a last notification appliance interconnected with the first notification appliance, and configured to transmit an output to the first notification appliance;

wherein each of the plurality of notification appliances comprises:

an interconnect input configured to receive an input signal from one of the plurality of notification appliances;

an interconnect output configured to transmit an output signal to another one of the plurality of notification appliances; and an alarm;

wherein the plurality of notification appliances are each interconnected to form a unidirectional loop configuration using at least one interconnect line extending therebetween for providing supervision between the plurality of notification appliances without the use of a central control panel;

wherein the unidirectional loop is a daisy chain loop, wherein the last notification appliance loops back to the first notification appliance; and wherein the plurality of notification appliances is configured to sound an interconnect alert if a change in state on the at least one interconnect line is not detected within a predetermined time period.

2. A supervised interconnect hazard alarm system as in claim 1, wherein each of the plurality of notification appliances receives data from the at least one interconnect line via an interconnect input and sends data via an interconnect output.

3. A supervised interconnect hazard alarm system as in claim 1, wherein the plurality of notification appliances changes a signal state on an output of the interconnect line so that each of the plurality of notification appliances will detect a change in state on a respective interconnect input.

4. A supervised interconnect hazard alarm system as in claim 1, wherein the at least one interconnect line is used to indicate a fault condition.

5. A supervised interconnect hazard alarm system as in claim 1, wherein the interconnect line is a wireless connection.

6. A supervised interconnect hazard alarm system as in claim 1, wherein the system detects at least one of the presence of smoke or carbon monoxide (CO).

7. A hazardous environment condition notification appliance system comprising:

a plurality of notification appliances comprising:

a first notification appliance;

a second notification appliance interconnected with the first notification appliance and configured to receive an input from the first notification appliance; and a last notification appliance interconnected with the first notification appliance, and configured to transmit an output to the first notification appliance;

an interconnect line extending between each of the plurality of notification appliances;

wherein each of the plurality of notification appliances includes interconnect input and an interconnect output for connecting the plurality of interconnect appliances into a unidirectional loop configuration for detecting operational status between each one of the plurality of interconnect appliances;

wherein the unidirectional loop is a daisy chain loop, wherein the last notification appliance loops back to the first notification appliance; and wherein each of the plurality of notification appliances includes an alarm and is configured to sound an interconnect alert if a change in state on the at least one interconnect line is not detected within a predetermined time period.

8. A hazardous environment condition notification appliance system as in claim 7, wherein each of the notification appliances receives data from the interconnect input and sends data via the interconnect output for alerting the plurality of notification appliances of at least one alarm type.

9. A hazardous environment condition notification appliance system as in claim 7, wherein the plurality of notification appliances changes a logic state on its interconnect output so that at least one remaining notification appliance of the plurality of notification appliances will detect a change in logic state on its respective interconnect input.

10. A hazardous environment condition notification appliance system as in claim 7, wherein the interconnect alert indicates a fault on the interconnect line.

11. A hazardous environment condition notification appliance system as in claim 7, wherein the interconnect line is a wireless communication.

12. A notification appliance comprising:

an interconnect input connector configured to receive an input signal within a predetermined time period from a first remote notification appliance that is part of a supervised interconnected hazard alarm system;

an interconnect output connector configured to transmit an output signal to a second remote notification appliance that is included in the supervised interconnected hazard alarm system within a predetermined time period;

a processor in communication with the interconnect input and the interconnect output, the processor configured to determine if the input signal is received within a predetermined time period so as to indicate the first remote notification appliance is operating properly; and an alarm in communication with the processor for generating an alarm, wherein the processor is configured to cause the alarm to generate an alert if the input signal is not received within the predetermined time period;

wherein the predetermined time period of the input signal is approximately equal to the predetermined time period of the output signal; and wherein the notification appliance is configured to be one notification appliance in a unidirectional daisy chain loop of a plurality of notification appliances in the supervised interconnected hazard alarm system, wherein a last notification appliance is interconnected with a first notification appliance and configured to transmit an output signal to the first notification appliance.

13. A notification appliance as in claim 12, wherein each of the plurality of the plurality of notification appliances detects a change in signal state so that a fault condition can easily be detected during polling by another notification appliance of the plurality of notification appliances.

14. A notification appliance as in claim 12, wherein power to the notification appliance is supplied via at least one power bus and battery backup.

15. A notification appliance as in claim 12, wherein the notification appliance can detect at least one of smoke, fire, heat or carbon monoxide (CO).

16. A notification appliance as in claim 12, wherein the notification appliance is a visual strobe alarm.

17. A notification appliance as in claim 12 further comprising a radio frequency receiver and transmitter.

18. A supervised interconnect hazard alarm system as in claim 1, wherein at least some of the plurality of notification appliances are at least one of a smoke detector, a heat detector, a fire detector, and a CO detector.

19. A hazardous environment condition notification appliance system as in claim 7, wherein at least some of the plurality of notification appliances are at least one of a smoke detector, a heat detector, a fire detector, and a CO detector.

* * * * *